US009598878B1

(12) United States Patent
Nelson, Jr.

(10) Patent No.: US 9,598,878 B1
(45) Date of Patent: Mar. 21, 2017

(54) COMBINATION KEY AND LOCKING COVER

(71) Applicant: Wykaine L. Nelson, Jr., Laurel, MD (US)

(72) Inventor: Wykaine L. Nelson, Jr., Laurel, MD (US)

( * ) Notice: Subject to any disclaimer, the term of this patent is extended or adjusted under 35 U.S.C. 154(b) by 0 days.

(21) Appl. No.: 15/147,881

(22) Filed: May 5, 2016

(51) Int. Cl.

| | |
|---|---|
| ***A44B 15/00*** | (2006.01) |
| ***E05B 19/00*** | (2006.01) |
| ***A47G 29/10*** | (2006.01) |
| ***A45C 11/32*** | (2006.01) |

(52) U.S. Cl.
CPC ..... *E05B 19/0082* (2013.01); *A45C 11/32* (2013.01); *A45C 11/328* (2013.01); *A47G 29/10* (2013.01); *E05B 19/0017* (2013.01)

(58) Field of Classification Search
CPC .. E05B 19/00; E05B 19/0005; E05B 19/0082; A45C 11/32; A45C 11/325; A45C 11/326; A45C 11/327; A45C 11/328; A47G 29/10
See application file for complete search history.

(56) References Cited

U.S. PATENT DOCUMENTS

| | | | | |
|---|---|---|---|---|
| 2,854,132 | A * | 9/1958 | Bjerknes | A45C 11/32 70/456 R |
| 4,307,590 | A * | 12/1981 | Friedland | A45C 11/328 70/456 R |
| 5,051,724 | A * | 9/1991 | Morrow | E05B 19/0005 70/456 R |
| 5,083,662 | A | 1/1992 | Bishop et al. | |
| 5,311,758 | A | 5/1994 | Neitzke et al. | |
| 6,460,386 | B1 * | 10/2002 | Watanuki | E05B 19/0082 70/456 R |
| 6,553,802 | B1 * | 4/2003 | Jacob | E05B 19/0082 70/456 R |
| 6,672,118 | B1 * | 1/2004 | Wright | A45C 11/32 70/456 R |
| D648,207 | S | 11/2011 | Johnson | |
| D663,606 | S | 7/2012 | Doll et al. | |
| 8,359,891 | B2 * | 1/2013 | Fujimoto | E05B 19/0082 70/456 R |
| 2007/0151872 | A1 | 7/2007 | Vincent | |
| 2012/0186314 | A1 * | 7/2012 | Gonzales | G09F 3/20 70/456 R |
| 2013/0124277 | A1 | 5/2013 | Dooley et al. | |

FOREIGN PATENT DOCUMENTS

| | | |
|---|---|---|
| CN | 202544525 U | 11/2012 |
| JP | 9-75202 A | 3/1997 |

* cited by examiner

*Primary Examiner* — Christopher Boswell
(74) *Attorney, Agent, or Firm* — Richard C. Litman

(57) ABSTRACT

The combination key and locking cover provides a decorative key and a decorative cover for the blade of the key in order to aid in loss prevention of the key, as well as providing protection for the user from the cuts in the blade of the key. The key includes a head, a locking hub mounted on a lower portion of the head, and a blade secured to the locking hub and projecting downwardly therefrom. The cover has opposed upper and lower ends, with a rim being formed at the upper end of the cover, and a recess formed inside the cover. The locking hub of the key is releasably lockable to the rim of the cover, such that when the locking hub of the key is attached to the rim, the blade of the key is releasably contained within the recess.

3 Claims, 2 Drawing Sheets

COMBINATION KEY AND LOCKING COVER

BACKGROUND OF THE INVENTION

1. Field of the Invention

The present invention relates to keys and particularly to a decorative cover which releasably locks onto a key and covers the blade thereof.

2. Description of the Related Art

A conventional key includes a bow (or head), a shoulder and a blade with cuts being formed therein. Most modern keys are relatively small, allowing them to be easily carried in a hand, pocket or on a key chain. The small size of the key, as well as how often such keys are used throughout the day, makes keys relatively easy to lose. Additionally, due to the sharp cuts made in the blades, keys can accidentally injure the user, particularly when stored in a pants pocket or the like. It would be desirable to be able to provide a key that is less prone to loss. Thus, a combination key and locking cover solving the aforementioned problems is desired.

SUMMARY OF THE INVENTION

The combination key and locking cover provides a decorative key and a decorative cover for the blade of the key in order to aid in loss prevention of the key, as well as providing protection for the user from the cuts in the blade of the key. The key includes a head, having opposed upper and lower portions, a locking hub mounted on the lower portion of the head, and a blade secured to the locking hub and projecting downwardly therefrom. The cover has opposed upper and lower ends, with a rim being formed in the upper end of the cover and a recess formed inside the cover. The locking hub of the key is releasably lockable within the rim of the cover, such that when the locking hub of the key is attached to the rim of the cover, the blade of the key is releasably contained within the recess formed in the cover.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
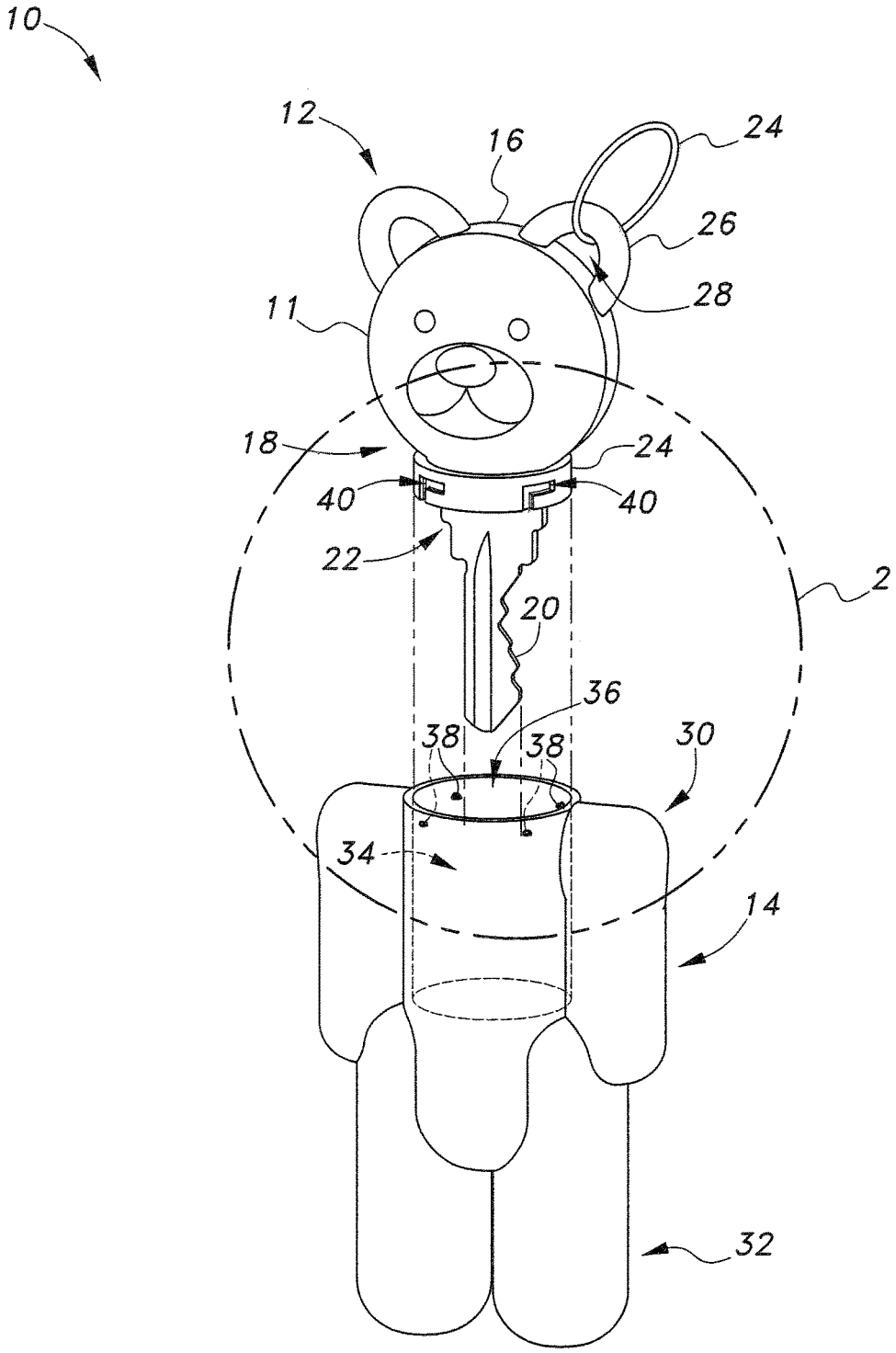
FIG. 1 is an exploded view of a combination key and locking cover according to the present invention.

The combination key and locking cover 10 includes a key 12 and a cover 14 for the blade 20 of key 12 in order to aid in loss prevention of the key 12, as well as providing protection for the user from the cuts in the blade 20 of the key 12. The key 12 and cover 14 can have any desired decorative configuration. As shown in FIG. 1, the key 12 includes a head 11, having opposed upper and lower portions, 16, 18, respectively, a locking hub 24 mounted on the lower portion 18 of head 11, and a blade 20 secured to the locking hub 24 at the blade's upper end 22. As shown, the blade 20 projects downwardly from locking hub 24. Compared with a conventional key, the head 11 replaces the conventional bow of a key, and the locking hub 24 replaces the conventional shoulder of the key. The blade 20 is similar to a conventional blade of a Yale-type key or the like, with an elongated body having cuts formed therein.

In the example of FIG. 1, the head 11 of decorative key 12 is shown as being simulative of a bear. It should be understood that the ornamental appearance of head 11 (and of the corresponding cover 14) is shown in FIG. 1 for exemplary purposes only, and may have any desired ornamental appearance. Further, as shown in FIG. 1, a key ring 24 may be provided, with a portion thereof being secured to the upper portion 16 of head 11 through an opening 28. In the example of FIG. 1, the opening 28 is formed through a looped ear 26 of the bear's head, however it should be understood that this configuration is particular to the exemplary ornamental design, and that opening 28 may be formed through any suitable portion of head 11 or, alternatively, any suitable portion of cover 14. Head 11 may be formed from any suitable material, such as plastic or the like. Preferably, head 11, locking hub 24 and blade 20 are manufactured together, forming an integral unit.

The cover 14 has opposed upper and lower ends, 30, 32, respectively, with a rim 36 being formed in the upper end 30 and a recess 34 formed inside the cover 14. In the example of FIG. 1, the cover 14 is shown as being simulative of a bear's body, matching the ornamental appearance of head 11. It should be understood that the ornamental appearance of cover 14 is shown in FIG. 1 for exemplary purposes only, and may have any desired ornamental appearance. Recess 34 may have any suitable positioning, contouring or overall dimensions, dependent upon the decorative configuration of cover 14, such that blade 20 of key 12 may be releasably stored therein. Cover 14 may be formed from any suitable material, such as plastic or the like.

The locking hub 24 of the key 12 is releasably lockable within the rim 36 of the cover 14. When the locking hub 24 of key 12 is locked in rim 36 of cover 14, the blade 20 of key 12 is releasably contained within recess 34. Although any suitable type of releasable locking mechanism may be used to releasably secure the locking hub 24 to the rim 36, a twist lock is preferably used, such that upon insertion of blade 20 within recess 34, the user may twist the head 11 with respect to cover 14 to releasably lock the head 11 in place.

Figure 2:
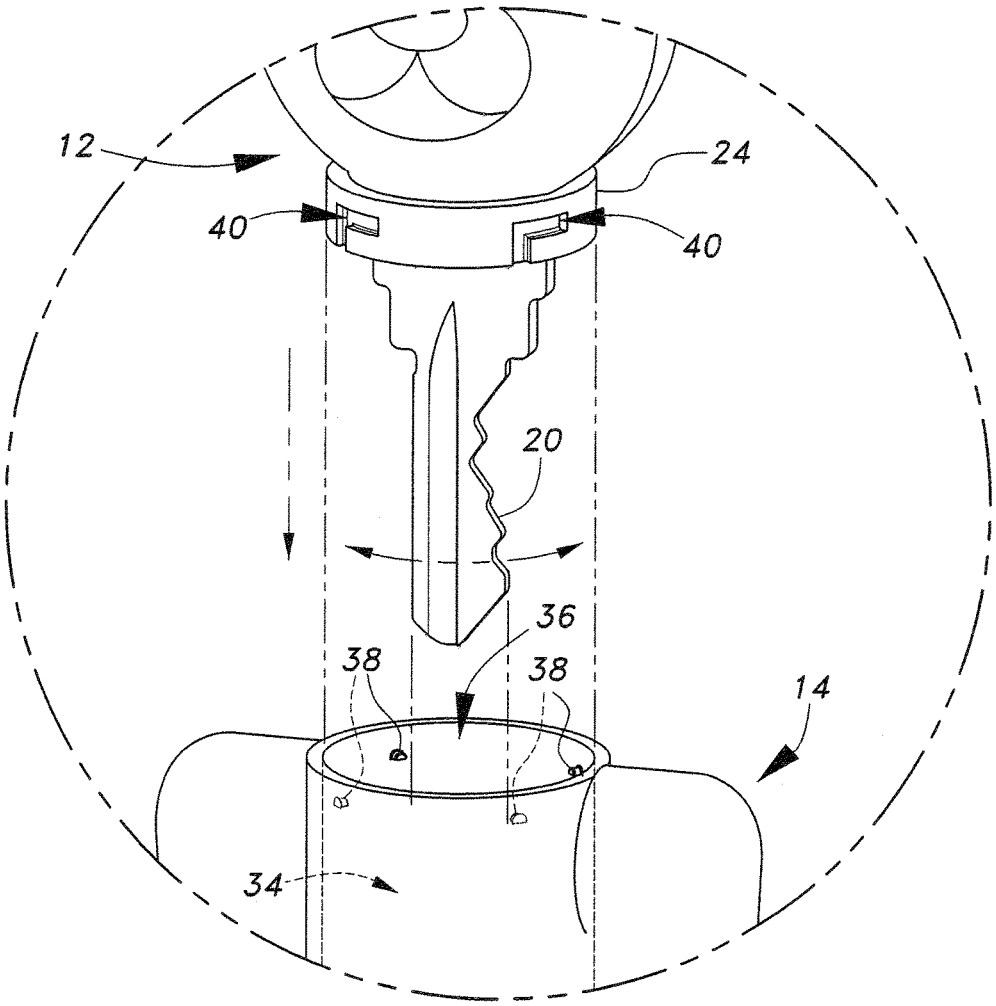
FIG. 2 is a partial exploded view of the combination key and locking cover according to the present invention.

As best seen in FIG. 2, at least one groove 40 is preferably formed circumferentially in the locking hub 24 of key 12. Correspondingly, at least one locking tab 38 is mounted in the rim 36 of the cover 14, forming a releasable twist lock. When the blade 20 of key 12 is inserted into recess 34 of cover 14, the at least one locking tab 38 engages the at least one groove 40 of locking hub 24, allowing the user to twist head 11 with respect to cover 14 to releasably lock the head 11 in place.

It is to be understood that the present invention is not limited to the embodiments described above, but encompasses any and all embodiments within the scope of the following claims.

I claim:

1. A combination key and locking cover adapted to complete an imitative representation of an animal, comprising:

a key including:

a head having opposed upper and lower portions, wherein the head has a first configuration that defines a first portion of the imitative representation of the animal;

a locking hub mounted on the lower portion of the head, wherein a plurality of bayonet slots are formed circumferentially about the locking hub; and a blade secured to the locking hub and projecting downwardly therefrom; and a cover having opposed upper and lower ends, wherein the cover has a second, distinct configuration that defines a second portion of the imitative representation of the animal, a rim being formed at the upper end of the cover, a plurality of locking tabs mounted to the rim of the cover, and a recess formed in the cover between the opposed upper and lower ends, wherein the locking hub of the key is releasably lockable to the rim of the cover by releasable engagement of the plurality of locking tabs in the plurality of bayonet slots formed circumferentially in the locking hub, whereby when the locking hub of the key is attached to the rim of the cover, the blade of the key is releasably contained within the recess formed in the cover and the first and second configurations combine to complete the imitative representation of the animal.

2. The combination key and locking cover as recited in claim 1, further comprising a key ring.

3. The combination key and locking cover as recited in claim 2, wherein a portion of the key ring passes through an opening formed through the upper portion of the head of the key.

* * * * *